US007121902B2

(12) United States Patent
Gelman et al.

(10) Patent No.: US 7,121,902 B2
(45) Date of Patent: Oct. 17, 2006

(54) LEVER-LIKE CONTACT ELEMENT

(75) Inventors: Alexander Gelman, Fellbach (DE); David Silva, Nürtingen (DE); Ortwin Zoller, Altdorf (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/916,763

(22) Filed: Aug. 11, 2004

(65) Prior Publication Data

US 2005/0037676 A1 Feb. 17, 2005

(30) Foreign Application Priority Data

Aug. 11, 2003 (DE) ..... 103 36 845
Dec. 11, 2003 (DE) ..... 103 57 898

(51) Int. Cl.
*H01R 4/48* (2006.01)

(52) U.S. Cl. ..... 439/862; 439/76.1; 439/916; 343/713; 343/906

(58) Field of Classification Search ..... 439/862, 439/76.1, 916, 937; 343/906, 713
See application file for complete search history.

(56) References Cited

U.S. PATENT DOCUMENTS 4,262,986 A 4/1981 Cherian et al.
4,969,842 A * 11/1990 Davis ..... 439/629
5,231,274 A * 7/1993 Reynier et al. ..... 235/441
5,378,160 A * 1/1995 Yumibe et al. ..... 439/66
6,025,806 A * 2/2000 Deininger et al. ..... 343/713
6,118,410 A * 9/2000 Nagy ..... 343/713
6,198,444 B1 * 3/2001 Sailsman et al. ..... 343/702
6,411,259 B1 * 6/2002 Wendt et al. ..... 343/713
6,625,881 B1 * 9/2003 Ammar et al. ..... 29/830
6,903,698 B1 * 6/2005 Silva ..... 343/713

FOREIGN PATENT DOCUMENTS

| | | |
|---|---|---|
| DE | 41 06 604 | 9/1991 |
| DE | 41 18 312 | 12/1992 |
| DE | 201 01 938 | 7/2001 |
| DE | 199 34 302 | 2/2003 |
| EP | 1 076 382 | 2/2001 |

* cited by examiner

*Primary Examiner*—Briggitte Hammond
*Assistant Examiner*—Xuong Chung-Trans
(74) *Attorney, Agent, or Firm*—Andrew Wilford

(57) ABSTRACT

A contacting device, especially for an antenna amplifier in an automotive application to contact an antenna on a windshield or rear window of the vehicle has a lever-like contact element in the form of a strap or stirrup and bends lying in a plane and bearing upon the surfaces and bridging between them.

3 Claims, 2 Drawing Sheets

LEVER-LIKE CONTACT ELEMENT

FIELD OF THE INVENTION

Our present invention relates to a lever-like contact element especially for making an electrical contact between a part of a vehicle and a printed circuit board forming part of an antenna amplifier.

BACKGROUND OF THE INVENTION

The formation of an electric contact between two surfaces utilizing a contact element can be used, for example, for electrical contact with flat antenna conductor structures in motor vehicles. From DE 196 05 999 A1, for example, the contacting of a flat antenna conductor structure is known. In this case, below a portion of the vehicle body a signal processing unit, especially an antenna amplifier, is mounted by appropriate fasteners. The housing of this unit has a carrier in the form of an outrigger arm provided at its end with contacts. The contacts are connected by connecting conductors which can be arranged in or on the rigid carrier and connected in turn with the signal processing unit. The contacts can make electrical contact with the contact surfaces or pads of an antenna conductor structure which can be provided, for example, upon the vehicle windshield or rear window. The carrier enables the signal processing unit to be positioned a certain distance away from the antenna conductor structure. However, because of the inflexibility of the rigid structure and the fact that only limited space may be available in the vehicle to accommodate the signal processing unit, the signal processing unit itself and the location at which the signal processing unit is to be mounted must be fabricated with narrow tolerances. It is desirable, by contrast, to have a wide tolerance range for the positioning of the signal processing unit and for the contacting of the contact surfaces or pads of the antenna conductor structure.

A further drawback of the prior art construction is that the entire signal processing unit with the carrier and the contacts on the carrier must be replaced completely or as a unit when it is damaged, for example, in the case of a vehicle crash. This need for replacement of the entire unit involves high cost especially since the signal processing unit as a rule must be integrated between the vehicle body and the ceiling of the vehicle and thus is not readily accessible.

It is also a disadvantage of the prior art structures described that with rigid carriers, the signal processing unit must be designed for the particular vehicle geometry and as a result different signal processing unit configurations must be provided for the various vehicle body types. This matching of the signal processing unit to the particular vehicle body types is likewise associated with high cost since different tools (molds) may be necessary for fabricating the different signal processor housings, the different types of signal processors have to be stocked without necessarily knowing which particular housing configuration will be required as a replacement for a damaged unit, etc.

OBJECTS OF THE INVENTION

It is, therefore, the principal object of the present invention to provide a contact arrangement which is especially useful to affect electrical contact between two surfaces and which provides a wide range of tolerances, especially with respect to the positioning of the housing or device carrying the contact.

Another object is to provide a device for making an electrical contact between a first contact surface and at least one other contact surface and which includes a contact element whereby the drawbacks described above can be avoided and which is especially inexpensive and capable of mass production.

Still another object of this invention is to provide an improved contact arrangement between contact surfaces or pads of an antenna conductor structure and a printed circuit board carrying an antenna signal processor such as an antenna amplifier.

SUMMARY OF THE INVENTION

These objects and others which will become apparent hereinafter are attained, in accordance with the invention, firstly, in a device for contacting a first contact surface with at least one further contact surface via a contact element which has a lever action, i.e. is fulcrumed at least at one region of the contact element and has a pair of bends lying in a plane and respectively bearing upon the two contact surfaces and preferably in the form of a strap or stirrup.

In a second aspect of the invention, the contact element is carried by a housing for an antenna signal processing unit, for example, an antenna amplifier and makes electric contact between one contact surface which is a printed circuit board for that amplifier in the housing and a contact surface or pad of the antenna conductor or structure on a portion of a vehicle body.

According to the invention, therefore, the contact element has a lever like action, i.e. can be deflected about a fulcrum or a portion of that contact element functioning as a fulcrum and is formed as a strap or stirrup, preferably with an S-shaped configuration. It is important that the two contact surfaces which are contacted by mutual bends of the contact element lie in the same plane and effectively are neighboring so that for the electronic contact the shortest possible path is available for the electronic current passing between the contact surface. It is also important that the contact element be capable of bridging the gap between the contact surfaces. The strap or stirrup has the further advantage that it is capable of compensating for considerable tolerances by the deflection or bending of the strap or stirrup and the additional advantage that the strap or stirrup can be deformed by the two contact surfaces so that an intrinsic resilient force is created in the stirrup or strap to permanently press the contact element against both contact surfaces with sufficient force to insure effective and permanent electric contact between them.

Various configurations of the strap or stirrup are possible. For example, the strap or stirrup can be made from electrically nonconducting synthetic resin or some other electrically nonconductive material and can be provided with an electrically conductive coating which engages the two contact surfaces and makes the electrical connection between them. Alternatively, the strap or stirrup can be composed of intrinsically electrically conductive material. An electrically conductive synthetic resin or metal can be used for this purpose.

It is especially advantageous when the strap or the stirrup is a component of a printed circuit board of an electronic device or a component of a portion of the housing of the electronic device. Preferably, the contact element is an integral part of that housing and can bear upon the printed circuit board within the housing as well as upon another contact surface outside the housing, e.g. on a vehicle body to which the housing is secured. The contact element or a plurality of the contact elements can thus be integrated in the housing or connected with the circuit board so that upon insertion of the circuit board in the housing, contact is made with the contact elements and the circuit board thus constitutes the first contact surface.

This arrangement has been found to be especially effective for electronic devices like antenna amplifiers and the like which are to be mounted in vehicles. The antenna amplifier can be mass produced, tested and attached to the vehicle by the original equipment manufacturer, i.e. the automobile manufacturer, at a planned location in the vehicle. The strap or stirrup with its other bend is then pressed against the antenna pad or contact surface on the vehicle body when the housing is affixed thereto. The bendability of the strap or stirrup and the lever action thereof insures that the spring effect upon deformation of the contact element will maintain a firm, durable and reliable electrical connection between the contact element and both contact surfaces. The device can easily be removed should a defect be developed and be replaced.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
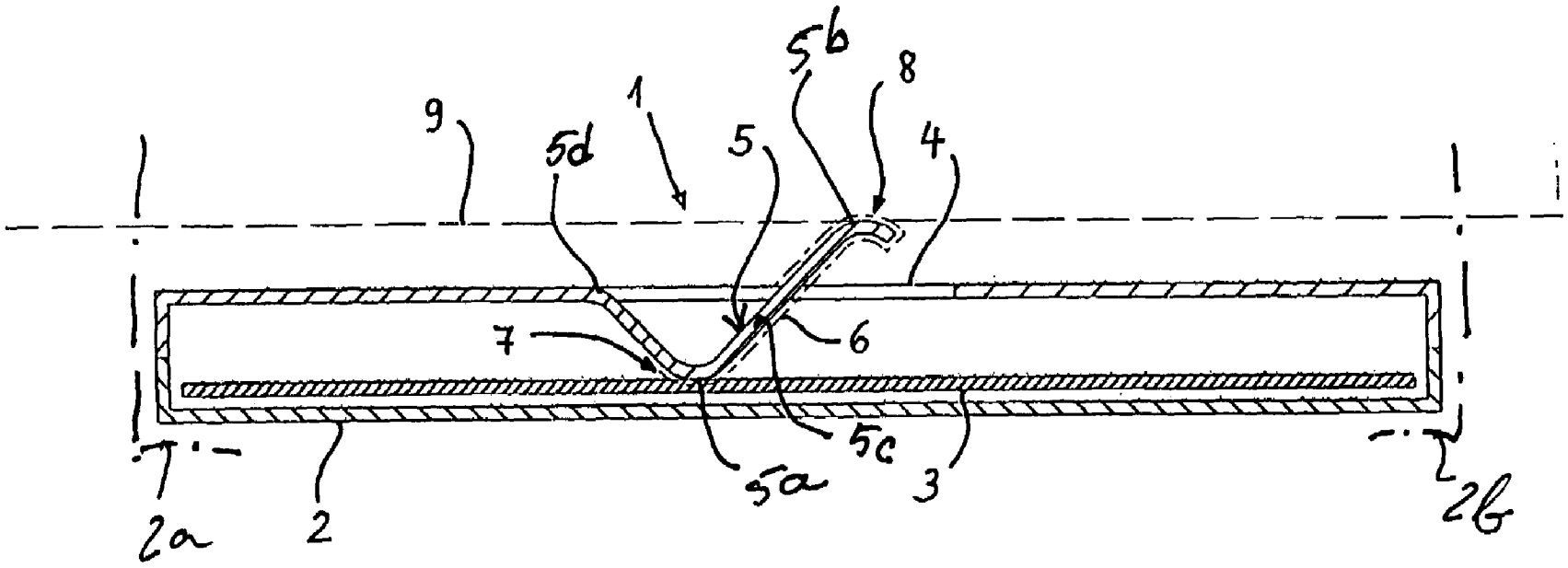
FIG. 1 is a cross sectional view through a first embodiment of the invention utilizing a lug or strap as the contact element.

FIG. 1 shows a device 1 for contacting in the sense of the invention and more particularly, for electrically connecting an electronic device, especially an antenna amplifier, with the antenna mounted on a vehicle body such as the windshield or rear window.

The device 1 in FIG. 1 comprises a housing 2 of the electronic device which can enclose a circuit board 3. The circuit board can carry the electrical, electronic and mechanical components required for the electronic device, for example, the antenna amplifier circuitry.

In the embodiment of FIG. 1, the housing 2 is formed with a cutout 4 through which a strap 5 can project. The strap 5 is bent from the cutout portion of the housing 2 and is thus integral therewith and comprises a bend 5*a* bearing upon the first contact surface 7 of the circuit board 3 and a bend 5*b* bearing upon the second contact surface 8 which can be a circuit pad of an antenna conductor structure on a flat surface 9 of the vehicle, for example, a windshield. The bends 5*a* and 5*b* are connected by a short stretch 5*c* which is resiliently deflectable.

The shape of the strap 5 enables it to act as a lever, since it is deflectable resiliently about a fulcrum which, for example, is formed by the bend 5*a*.

In the case in which the housing 2 is composed of an electrically nonconductive material, for example, a synthetic resin, the strap 5 is also composed of this material and the strap can then be coated with a conductive material as represented by the electrically conductive layer 6.

It is also possible to provide the strap 5 as an electrically conductive member which is targeted into the housing 2, e.g. by injection molding the housing 2 around the strap 5 at its junction 5*d* with the housing.

Since the strap 5 functions as a contact element, it electrically connects the contact surfaces 7, 8 in a plane, for example, the plane of the paper in FIG. 1. The means for attaching the housing 2 to the vehicle body has not been illustrated in detail but is represented by the dot-dash lines 2*a* and 2*b*. The contact element 5 thus functions to feed the signals from the antenna structure on the surface 9 to the circuit board 3.

The means 2*a*, 2*b* for attaching the housing to the vehicle body from a releasable connection, for example, a screw or lock arrangement, although a nonreleasable connection by adhesive or casting can also be provided. It is also possible for the housing 2 or the printed circuit board 3 not to be affixed to the component 9 but to be mounted on another component and held in place against the component 9 to make electrical contact therewith.

Instead of the housing 2, a one-piece or multi part type frame can be used for securing the circuit board 3 to the component 9 or some other part of the vehicle. The deflection of the strap 5 generates a force which maintains a permanent electrical contact of the bends 5*a* and 5*b* with the surfaces 7 and 8 and bridges tolerances between the contact surfaces.

Figure 2:
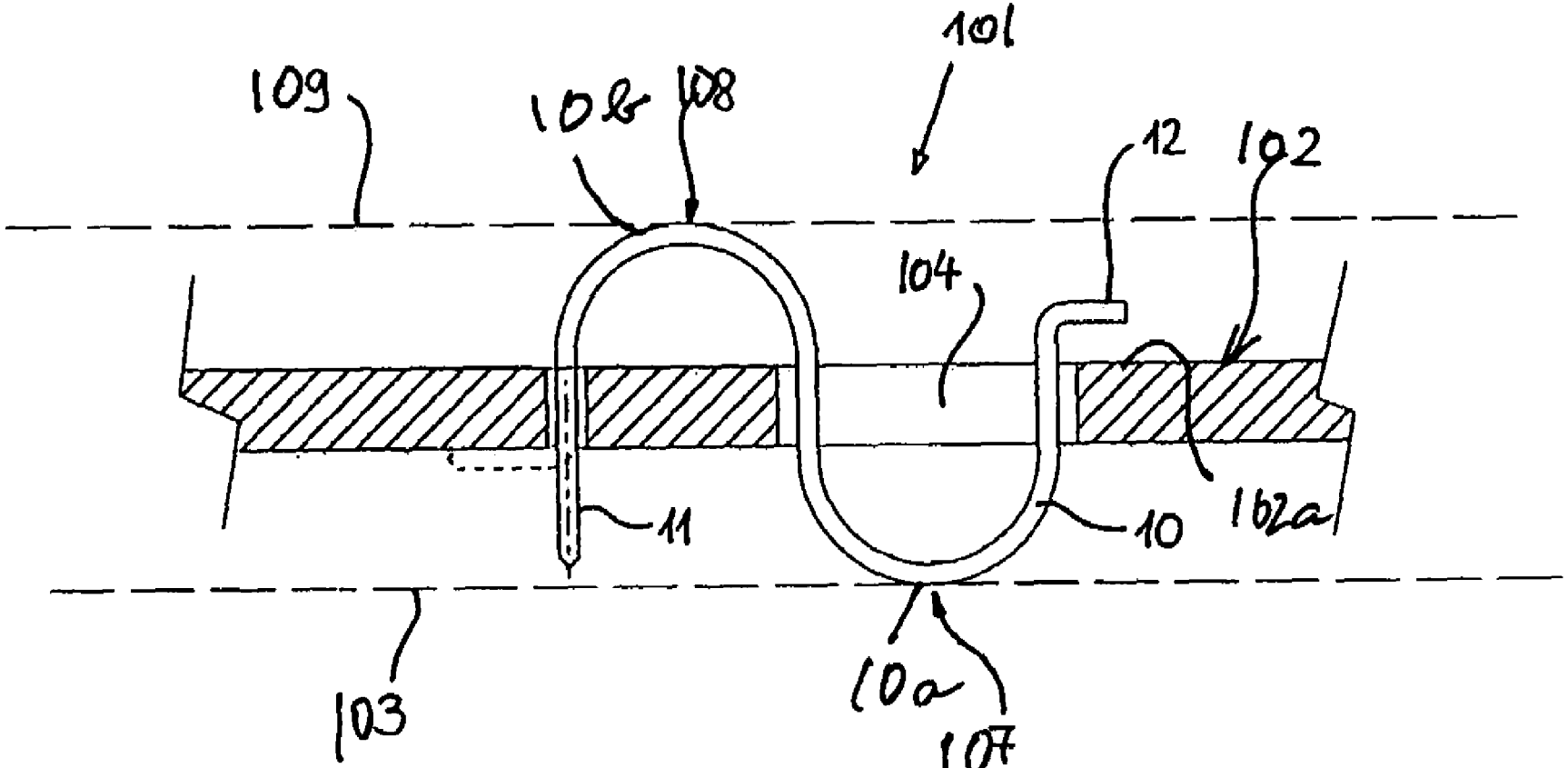
FIG. 2 is a cross sectional view through a second embodiment with the stirrup forming the contact element.

FIG. 2 shows the device 101 for contacting, e.g. between an antenna and an antenna amplifier, using a stirrup 10 with a generally S-shape configuration. In the embodiment of FIG. 2, a first end 11 of the stirrup 10 is anchored to the housing 102 or a cover, support frame or other component of the housing and can be attached or secured thereto by bonding or locking, e.g. by an adhesive or by bending the end 11 as shown in broken lines. That attachment can also be effected by soldering, coining, riveting, a toothed arrangement, ultrasonic welding or the like.

A second end 12 of the stirrup 10 is bent at an angle and forms an abutment with the surface 102*a* of the housing 2 in a rest position, thereby preventing the stirrup from falling out of the opening 104 in the housing 102. It also forms a stop preventing excessive deformation of the stirrup 10. The apexes of the bends 10*a* and 10*b* are provided at semicircular portions of the stirrup 10 in a common plane, i.e. the plane of the paper in FIG. 2, and are engageable with the contact surfaces 107 and 108 of the printed circuit board 103 and the antenna conductor surface 109 as previously described. Other geometric shapes of the stirrup can also be used. When the housing is urged toward the surface 109, the stirrup 10 is deformed, like the strap 5, and a durable reliable connection is provided.

An alternative to the embodiment of FIG. 2, provides that the end 11 of the stirrup 10 not be anchored to the housing 2 but can be secured to or bear against the printed circuit board 103. This end can be engageable with the board in an electrically insulated position so that it does not make a connection to a conductive track or component. In this case, the contact with the circuit board remains at the contact surface 107 as has been previously described. The end 11 can in another alternative be connected to the circuit board 3 at a point at which it makes electrically connection with a conductive track or component. In this case it is conceivable that the stirrup 10 not be S-shaped but is configured as a simple semicircular arc, although other geometric configurations are also possible.

In this latter case as well, the stirrup 10 may be S-shaped and can have additional contacting functions beyond the contacts made at the surfaces 7 and 8 with other tracks or components of the board.

We claim:

1. An antenna amplifier for an automotive vehicle having an antenna conductor structure, said antenna amplifier comprising:

a housing affixed to a body of said vehicle;

a circuit board carrying an antenna amplifier circuit in said housing, said housing being formed with a wall generally parallel to said circuit board; and a lever contact element in the form of a strap or stirrup formed in one piece with said wall and having an inwardly extending bend bearing upon said circuit board and an outwardly extending bend emerging from said housing through an opening in said wall and bearing upon said antenna conductor structure, said bends lying in a common plane.

2. The antenna amplifier defined in claim 1 wherein said contact element is composed of an electrically nonconductive plastic and coated with an electrically conductive layer making electrical contact between contact surfaces, of said circuit board and said antenna conductor structure.

3. An antenna amplifier for an automotive vehicle having an antenna conductor structure having a contact surface, said antenna amplifier comprising:

a housing wall affixed to a body of said vehicle, having an inner side turned away from the contact surface of the antenna conductor structure and an opposite outer side turned toward the contact surface of the antenna conductor structure, and formed with two throughgoing openings extending between the sides;

a circuit board carrying an antenna amplifier circuit and having a contact surface turned toward the inner side of the housing wall;

an S-shaped lever contact element affixed to said wall and having an end secured to the inner side of said wall, a portion passing through one of said openings past the outer side of said wall, a bend on said outer side of said wall bearing upon said contact surface of the antenna structure, another portion passing from said bend through the other of said openings past said inner side of said wall, a further bend extending from the other portion past said inner side of said wall and bearing upon the contact surface of the board, another portion extending from said further bend through said other of said openings past said outer side of said wall, and another end on said contact element bent to form an abutment against said outer side of said wall.

* * * * *